United States Patent [19]

Lotz

[11] 4,344,341

[45] Aug. 17, 1982

[54] SLICING APPARATUS

[76] Inventor: Walter E. Lotz, 904 Atlantic Dr. SE., Pt. Manalapan, Lantana, Fla. 33462

[21] Appl. No.: 183,874

[22] Filed: Sep. 4, 1980

[51] Int. Cl.[3] ..... B26D 5/00

[52] U.S. Cl. ..... 83/29; 83/42; 83/81; 83/91; 83/241

[58] Field of Search ..... 83/276–278, 83/240, 241, 222, 225–234, 81, 90–92.1, 29, 42

[56] References Cited

U.S. PATENT DOCUMENTS

| | | | |
|---|---|---|---|
| 1,396,290 | 11/1921 | Segschneider | 83/241 |
| 1,976,824 | 10/1934 | Ahrndt | 83/277 |
| 2,318,003 | 5/1943 | Mahler | 83/241 X |
| 2,832,388 | 4/1958 | Folk | 83/277 |
| 2,922,280 | 1/1960 | Rehlander | 83/231 X |
| 3,118,334 | 1/1964 | Blaha | 83/71 |
| 3,161,215 | 12/1964 | Werder et al. | 83/276 X |
| 3,204,676 | 9/1965 | Gillman | 146/94 |
| 3,670,793 | 6/1972 | Flesch | 146/94 R |
| 3,776,073 | 12/1973 | Runge | 83/278 X |
| 3,846,957 | 11/1974 | Divan | 53/59 W |
| 3,846,958 | 11/1974 | Divan | 53/59 W |
| 3,905,259 | 9/1975 | Spooner | 83/77 |
| 3,954,035 | 5/1976 | Hauberg | 83/278 X |
| 4,129,053 | 12/1978 | Kent | 83/69 |
| 4,181,053 | 1/1980 | Duddridge | 83/110 X |

*Primary Examiner*—James M. Meister

*Attorney, Agent, or Firm*—Leon Arthurs; Kenneth M. Garrett

[57] ABSTRACT

A method particularly applicable to the slicing of friable meat products with a rotaty cutting blade comprises feeding the product forwardly when it is not in contact with the cutting blade, and arresting the feeding when the slicing is taking place, and apparatus therefor. Provision is made to make the first slice of a stack somewhat thicker than the remaining slices in order to act as a carrier for the stack.

9 Claims, 6 Drawing Figures

SLICING APPARATUS

FIELD OF THE INVENTION

This invention relates to improvements in apparatus and method for slicing comestibles, particularly meat products. A type of product with which the invention is particularly concerned is the chip steak which is sliced from ground meat pressed into the form of a loaf measuring for example about 4 inches by 7 inches in cross section. Such loaf is usually tempered and handled at a temperature of about 25°-28° F. but is somewhat friable and flexible in nature.

BACKGROUND OF THE INVENTION

High speed meat slicing machines which as are contemplated herein have been available in commerce for many years, and the ANCO Model 827 may be particularly instanced. Such machines in their most rudimentary form comprise a continuously rotating blade in the shape of an involute disc, and a normally continuously advancing feed platform for urging bulk product into contact with the disc. It is often desired to accumulate slices cut from the slicing machine so as to form a stack for packaging. In such stacks the slices may typically be vertically concentred, or as an alternative fanned out. In both cases the stacks require to be separated. In one commonly employed method, the slicing is interrupted for a brief period during which a stacker conveyor is activated to remove an accumulated stack of slices.

The thickness of slices can be normally controlled within low tolerance limits when the slicing machine is operated continuously at relatively low speeds, eg. 100 slices per minute. When the feed is interrupted it is found that the tolerance in the thickness control is much higher, particularly when the slicing machine is operated at high speeds, eg. 200 slices per minute or in excess thereof.

The present invention particularly contemplates apparatus and method for slicing and accumulating very thin slices of chip steaks such as are currently utilized commercially for very high speed cooking operations. Such slices prior to cooking have a thickness typically in the range 0.06 inches to about 0.012 inches (1.5 mm to 0.3 mm); several slices together forming one meat filling for a hamburger or the like. It will be appreciated that such thicknesses approach the variation from the nominal thickness of thicker slices that are cut using traditional methods. It will further be appreciated that high speeds of operation are essential if the procedure is to be economically sound. Chip steaks are quite friable in nature even where of significantly greater thickness than that indicated above. Whilst it is desirable that the individual slices of a stack be of uniform thickness, this is not a pre-requisite; rather it is required that the several slices together form a stack of easily controlled, uniform thickness. For ease of handling, I find it desirable to slice the first slice of a stack somewhat more thickly than the remaining slices so as to act as a carrier therefor. This may be compensated for by commensurately reducing the thickness of one or more of the remaining slices of a stack; in practise it is desirable that just one slice thereof, normally the last slice, be reduced in thickness by a compensating amount. It will be appreciated that the cutting blade of the slicing machine, which rotates rapidly within a protective housing, functions also as an air propellor. The created air movement increases the settling period of the thin slices whereby this approaches the available time for conveying an accumulated stack from the stacker. Whilst it is possible to idle the cutting blade for a longer period between cutting the last slice of one stack and the first slice of the next stack, this is inimical with high production rates.

OBJECTS OF THE INVENTION

It is thus an object of my invention to provide a method for slicing which is particularly amenable to producing thinly sliced products.

It is another object of my invention to provide a method for slicing to produce slices of more readily controllable thickness.

It is yet another object of my invention to provide a method for the production of uniform stacks of sliced products.

It is a further object of my invention to provide apparatus for the fulfillment of these objects.

SUMMARY OF THE INVENTION

In accordance with the above, an apparatus for slicing broadly comprises a feeder for advancing material along a path, a cutting blade mounted for rotation so as to intersect the path intermittently, and control means for substantially arresting the advance of said feeder when said path is intersected.

Generally the apparatus will further comprise a stacker having a slice accumulating station, and removal means for the removal of a stack of accumulated slices, and the control means arrests the advance of the feeder for a time, normally one revolution of the cutting blade, to permit the removal of the stack by the removal means. Preferably a variable delay means is provided whereby the time period between cutting of the last slice of a stack and the actuation of the removal means is controllable so as to permit settling of the last slice of a stack prior to its removal.

Advantageously, the control means is settable to provide a generally uniform advance increment of the feeder for each cutting stroke of the cutting blade. It is preferred that the control means is also settable to provide a variance from the uniform advance increment for cutting the first and last slices of each stack.

The method of my invention in its broad aspect comprises providing a circular rotary cutting blade, feeding product forwardly on a continuous path for slicing by the cutting blade, and arresting the forward feeding when the rotary cutting blade is in substantial contact with the cutting blade. Preferably the feeding occurs over about 30° to about 60° of rotation of the cutting blade, and the arresting over the remaining 300° to 330° of the cycle. In a still further preferred method particularly associated with friable meat products, the advance of the feeder is greater when slicing the first slice of a stack than for intermediate slices thereof.

DETAILED DESCRIPTION

Figure 1:
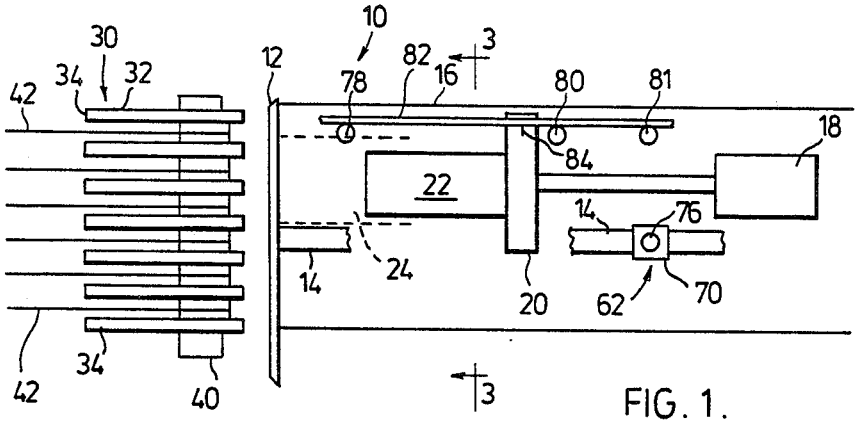
FIG. 1-shows in schematic plan form a slicing apparatus constructed in accordance with the invention.
Figure 2:
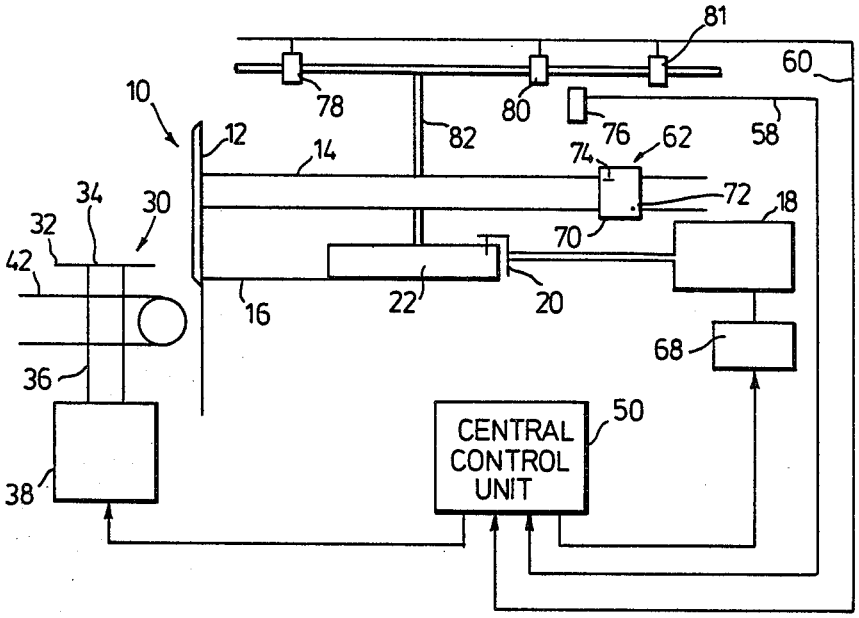
FIG. 2-shows the slicing apparatus of FIG. 1 in side elevation.
Figure 3:
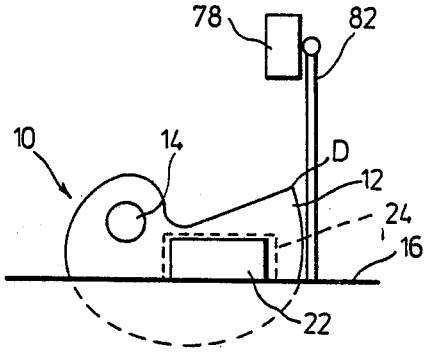
FIG. 3-shows the slicing apparatus of FIG. 1 in end elevation on line 3 of FIG. 1.

With reference to FIGS. 1-3, an exemplary slicing machine is indicated generally therein by the numeral 10 and may be seen to comprise a cutting blade 12 mounted for rotation on drive shaft 14 adjacent the end of table 16. A feeder 18 locates adjacent the other end of table 16, and includes a clamp 20 for contacting bulk product indicated generally as 22 and transmitting a thrust thereto so as to advance product 22 along an axial path on table 16 shown generally by dotted lines 24. Cutting blade 12 is shaped in the form of an involute, best seen in FIG. 3, and intersects path 24 for a portion of each revolution of the cutting blade. For reference purposes, cutting blade 12 is considered to rotate in a clockwise direction, as viewed in FIG. 3, and the datum (0° of revolution) is considered to be where the point D of maximum radius of the cutting blade is vertically downwards.

The above elements of a slicing machine are old and known in the art. In the method of operation believed to have been practised commonly heretofore feeder 18 was advanced continuously throughout the period of rotation of cutting blade 12. Product 22 can advance beyond cutting blade 12 when the cutting blade is substantially clear of path 24 ie, when the degree of rotation of the cutting blade is nominally in the range of about 0°-180°. In practise it will be noted that the degree of rotation in which the cutting blade does not intersect path 24 will vary somewhat with the dimensions of the bulk product on the path; where the cross sectional area of the bulk product is relatively small, the degree will be somewhat increased; where the cross sectional area of the product is relatively great, the degree will be somewhat decreased from the nominal range indicated. It will be clear, however that there will be a substantial interval during which the bulk product 22 will abut cutting blade 12. Where bulk product 22 is resilient, advance of the feeder 18 during such period will tend to compress the bulk product; as cutting blade 12 rotates further so as to clear path 24, such compression will be relieved to a greater or lesser extent by expansion of the bulk product through the cutting plane of the blade. In slicing generally rigid bulk products, advance of the feeder when the bulk product abuts cutting blade 12 will tend to result in relative movement between clamp 20 and the product clamped thereby. In general clamp 20 is toothed and the teeth tend to tear the bulk product as the clamp moves relative to the product so as to loosen the grip of the clamp and render the advance of the bulk product when clear of cutting blade 12 less positive.

Slicing machine 10 is normally associated with a stacker illustrated in exemplary form in FIGS. 1 and 2 and denoted generally by the numeral 30. Stacker 30 includes a station for accumulating slices cut by cutting blade 12, here formed by a platform 32 made up of a plurality of fingers 34, supported on the shaft 36 of air motor 38 which underlays the platform. A conveyor 40 comprising a plurality of belts 42 in axial alignment with fingers 34 locates generally below platform 32 and above air motor 38. Whilst stacker 30 is here shown as being close coupled to slicing machine 10 so as to receive slices directly from cutting blade 12, it will be appreciated that an intermediate conveyor means may be interposed between the cutting blade and the stacker.

Figure 4:
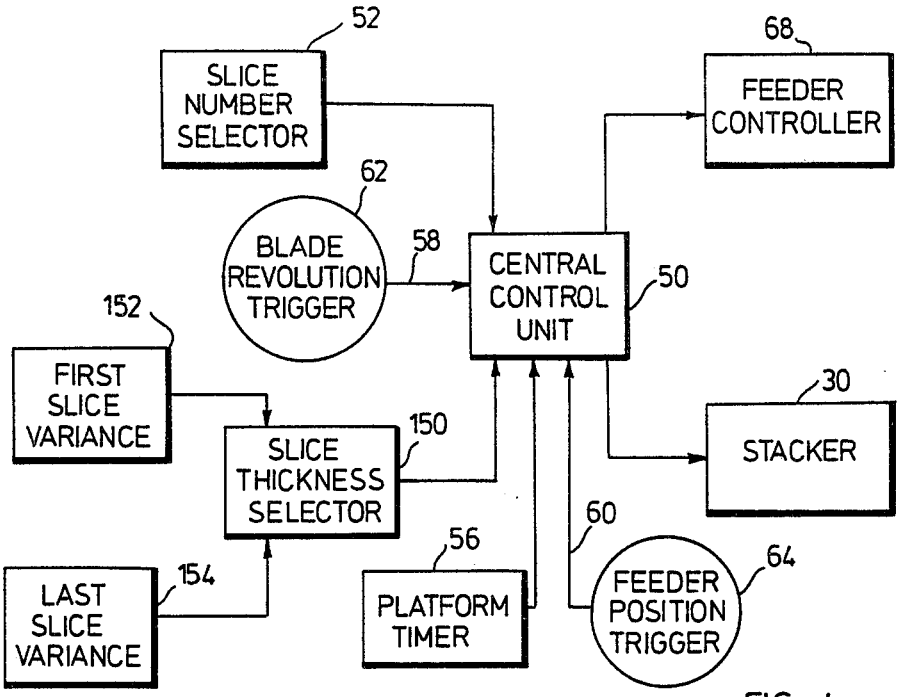
FIG. 4-shows in block form control means comprising part of the slicing apparatus of FIG. 1.

A control circuit for cutting machine 10 and stacker 30 is shown in block outline in FIG. 4, elements thereof also being seen in FIG. 2 and comprises a central control unit 50 having user settable inputs thereto comprising slice number selector 52, slice thickness selector 150, and platform timer 56. Inputs derived from slicing machine 10 are provided on lines 58 and 60 from blade revolution trigger and feeder position trigger 62 and 64 respectively. Output signals from central control unit 50 are provided to feeder controller 68 and stacker 30. Reverting particularly to FIGS. 1 and 2, blade revolution trigger 62 includes a collar 70 mounted on shaft 14 and rotatable with respect thereto, and a set screw 72 for fixing the collar relative to the shaft. Collar 70 further includes a contrasting mark 74 thereon. A photoelectric cell 76 is mounted above collar 70, and a pulse signal is generated on line 58 when mark 74 is in alignment with the photoelectric cell on each revolution of shaft 14 and cutting blade 12 therewith. Normally such pulse signal will be output on line 58 when the cutting blade is in the datum position, but such pulse signal may be advanced or retarded by movement of collar 70 relative to shaft 14. Feeder position trigger 64 includes first, second and third detector switches 78, 80 and 81 here comprising photoelectric cells mounted above path 24 from gantry 82 so as to be axially adjustable. A contrasting mark 84 is provided on clamp 20 so as to be detectable by photoelectric cells 78, 80 and 81 when the clamp 20 locates beneath the respective photoelectric cells, and thereby provide a signal on line 60 indicative of the forward, rearward and intermediate limit positions set for movement of clamp 20. It may be noted that it is here assumed that product 22 is of uniform axial length; where this is not so, limit switch 80 will be preferably actuated by the forward end of the product, rather than determining the position of clamp 20. It will be apparent that other signal generating means may be equally utilized for triggers 62 and 64.

Figure 5:
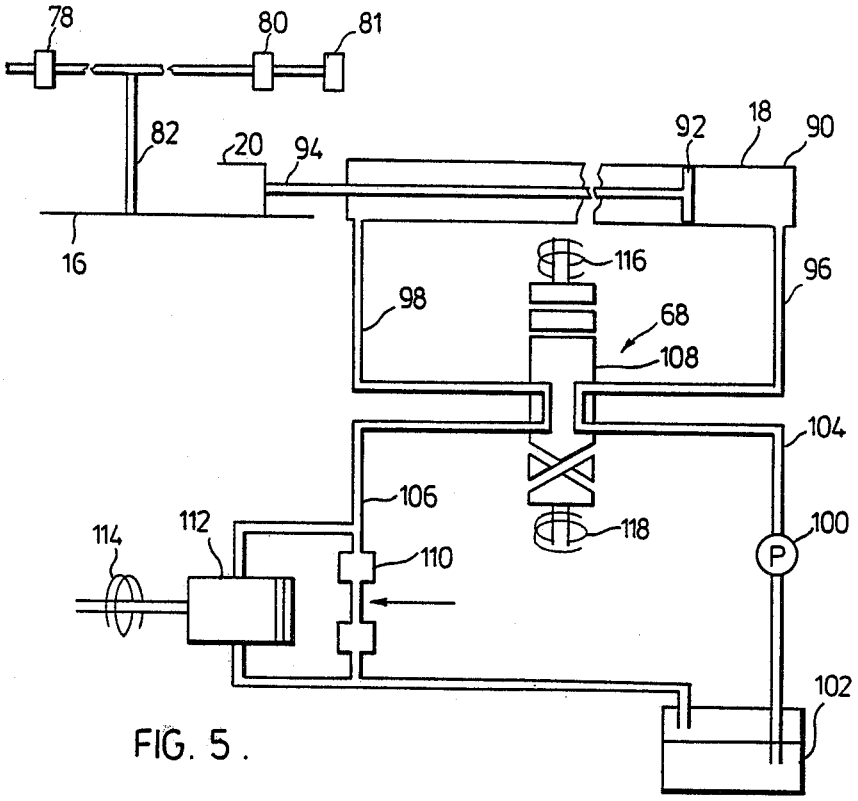
FIG. 5-shows hydraulic control means used in conjunction with the apparatus of FIG. 1, and FIG. 6-shows in graphical form typical duty cycles of the feeder in cutting a stack of slices.

An exemplary hydraulic feeder 18 and controller 68 therefor are shown schematically in FIG. 5. Feeder 18 comprises a hydraulic cylinder 90 having a piston 92 mounted for reciprocal movement therein and connected by shaft 94 to clamp 20. Cylinder 90 has hydraulic flow lines 96, 98 connected at the respective ends thereof. A pump 100 driven by shaft 14 connects to a fluid reservoir 102 to provide hydraulic fluid under pressure in line 104. Continuous forward movement of feeder 18 is effected by connecting fluid pressure line 104 to flow line 96, and additionally by connecting flow line 98 to a return line 106 which returns fluid back to tank 102. Such connections are made by a slide valve 108 when in its central, open position, as seen in FIG. 5. The rate of advance of feeder 18 is proportional to a variable resistance 110 placed in line 106 which acts to control the flow of fluid from cylinder 90.

RAPID ADVANCE AND RETURN OF FEEDER

Assuming a slab of bulk product 22 to have been placed in clamp 20, it is normally desired to advance the feeder 18 rapidly towards cutting blade 12. For this purpose I provide a normally closed valve 112 in parallel with flow resistance 110 activated by a solenoid 114 upon a user generated start signal. Piston 92 is rapidly advanced until a stop signal is generated at intermediate limit switch 80, whereupon solenoid 114 is deactivated and valve 112 reverts to its closed position. Assuming the bulk product 22 to be sliced to completion, a signal generated at forward limit switch 78 serves to activate a reversing solenoid 116, drawing valve 108 upwardly (with reference to the particular orientation of the valve in FIG. 5) so as to connect fluid pressure line 104 to line 98, and line 96 to 106, thereby reversing the connections to cylinder 90. Contemporaneously solenoid 114 is activated to by-pass flow restriction 110 to effect the rapid return of feeder 18 to the rearward position of clamp 20, whereupon limit switch 81 signals and solenoid 116 is deactivated. The signal from switch 81 also serves to activate a third solenoid 118 drawing valve 108 downwardly and isolating cylinder 90 from the fluid pressure line 104 as a safety measure. During the reversal of feeder 18 limit switch 80 is deactivated whereby any output signal therefrom is not responded to.

ADVANCE OF FEEDER WHEN SLICING

Assuming now bulk product 22 to have been advanced by feeder 18 along path 24 whereby the forward end of the bulk product is in proximity to cutting blade 12, the advance of feeder 18 is made discontinuous, in phase with the rotation of the cutting blade. Upon receipt of a signal from trigger 62, controller 50 provides a delayed output to activate solenoid 118 to turn valve 108 off, and arrest the advance of feeder 18. Solenoid 118 remains activated for the remainder of the cycle of cutting blade 12, being turned off by the next signal from trigger 62 to complete a cycle. The precise point of generation of the trigger signal relative to the position of cutting blade 12 may be readily altered by rotating collar 70 relative to shaft 14. The off to on ratio controlling solenoid 118 is varied by user settable control 150, which thus acts to set a generally uniform advance of feeder 18 in the course of the cutting blade cycle, and therefore to control the thickness of a slice. The trigger signal from 62 and the duration of the off period of solenoid 118 will normally be adjusted so that bulk product 22 advances along path 24 when the path is substantially not intersected by cutting blade 12, whereby the advance of the bulk product is not impeded. Provision is made at 152 to vary the time set at 150 for the first revolution of the cutting blade 12 for a given stack, the number of slices therein being settable at user control 52, so as to either decrease the thickness of the first slice or, more usually, increase the thickness. Provision is made at 154 to vary the time set at 150 for the last revolution of the cutting blade 12 for a given stack, whereby the thickness of the last slice of each stack may be varied from the thickness of intermediate slices. The times set at controls 52, 152 and 154 may be absolute, or preferably they will be related to the period of rotation of cutting blade 12 so that the times represented thereby vary automatically with adjustment of the speed of the cutting blade.

Figure 6:
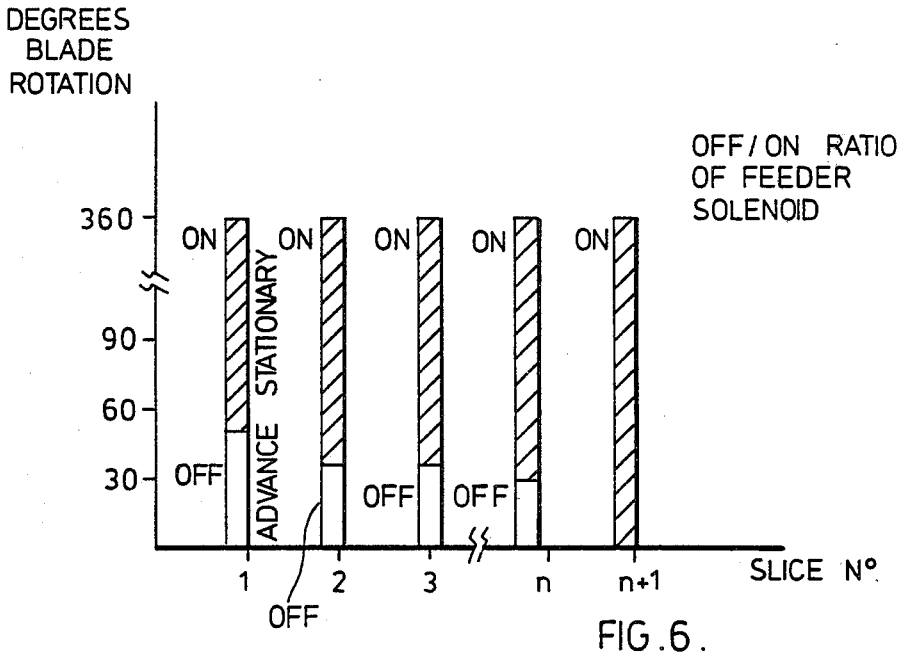

Referring to FIG. 6, output signals from central control unit 50 to solenoid 118 are shown graphically therein, the duration of each signal being expressed in terms of degrees of blade revolution. Whilst the off signals which to serve to advance feeder 18 are indicated as being initiated at 0° of blade rotation, as earlier defined, there may be substantial variation therefrom. For example, when the speed or revolution of cutting blade 12 is relatively high, it may be desirable to advance the onset of the off signal to counteract inertia and delay in the mechanical and hydraulic mechanisms. Expediently such advance is effected by angularly displacing collar 70 so as to advance trigger 62. It will be appreciated that an advanced output of trigger 62 may be fixed relative to the rotation of cutting blade 12 and that a variable delay period may be introduced in central control unit 50 or elsewhere as is convenient. Desirably the forward movement of feeder 18 occurs over an angular interval of about 30° of blade rotation to about 60°.

STACKER CONTROL

Still referring to FIG. 6, no off period is provided for solenoid 118 in the course of the (n+1) revolution of cutting blade 12 which follows the cutting of the last (nth) slice of the stack thereby providing a theoretical time interval during which stacker 30 may be actuated so as to remove an accumulated stack of approaching two revolutions of the cutting blade i.e. 0.174 secs., assuming the cutting blade to be rotating typically at 690 rpm. In practice it is found that this time may be substantially reduced when there is a difference in the thickness of the first and last slices as thinner slices have a longer settling period than is found for thicker slices. Platform timer control 56 (FIG. 4) is user settable to delay or advance the operation of motor 38 of stacker 30 on its down-stroke relative to the angle of rotation of cutting blade 12, so as to permit settling of the slices prior to the operation of stacker 30.

I claim:

1. Apparatus for the high speed slicing of friable products comprising:

a slicing machine including a path;

a cutting blade mounted for rotation to intersect said path intermittantly;

a feeder for advancing said friable product along said path in uniform increments when said path is not intersected by said cutting blade;

a slice accumulating station;

removal means for the removal of a stack of accumulated slices from said accumulating station, and control means for enabling said removal means upon accumulation of a stack of slices and for advancing said feeder by an amount marginally greater than said uniform increment for advancing the first slice to be cut following said stack removal.

2. A slicing apparatus as defined in claim 1 wherein said control means arrests the advance of said feeder for a time to permit the removal of said stack by said removal means.

3. A slicing apparatus as defined in claim 1 including variable delay means for delaying the actuation of said removal means.

4. A slicing apparatus as defined in claim 2, 3 or 1 wherein said cutting blade is in the form of an involute disc.

5. A slicing apparatus as defined in claim 2, 3 or 1 wherein said feeder includes a hydraulic motor.

6. A slicing apparatus as defined in claim 2, 3 or 1 wherein said control means includes a valve actuatable between first and second positions, and said feeder includes a hydraulic motor, said valve in one said position impeding the flow of fluid through said motor and in the other said position permitting said flow.

7. A slicing apparatus as defined in claim 2, 3 or 1 including at least one detector for detecting the position of said feeder relative to said cutting blade, said control means permitting a continuous advance of said feeder towards said detector and upon receipt of a signal from said detector advancing said feeder discontinuously as aforesaid.

8. A method of thinly slicing friable meat products to produce a stack of slices comprising providing an acircular rotary cutting blade, feeding said product forwardly a preset distance for slicing by said cutting blade, arresting the forward feeding during the time the rotary cutting blade is in substantial contact with said product, and automatically increasing said preset distance for cutting the first slice of each stack, whereby the settling time of said first slice is decreased in comparison to remaining slices of the stack.

9. A method as defined in claim 8 wherein said feeding occurs during an interval of rotation of said cutting blade of about 30° to about 60°.

* * * * *